United States Patent [19]

Elkins et al.

[11] 4,333,524

[45] * Jun. 8, 1982

[54] HIGH EFFICIENCY FURNACE

[75] Inventors: Robert H. Elkins, Hinsdale; Gary M. Durkin, Justice; Robert A. Macriss, Deerfield, all of Ill.

[73] Assignee: Southern California Gas Company, Los Angeles, Calif.

[ * ] Notice: The portion of the term of this patent subsequent to Feb. 10, 1998, has been disclaimed.

[21] Appl. No.: 232,807

[22] Filed: Feb. 9, 1981

Related U.S. Application Data

[63] Continuation of Ser. No. 16,206, Feb. 28, 1979, Pat. No. 4,249,594.

[51] Int. Cl.[3] ..... F28D 13/00; F22B 23/06; F28B 7/00

[52] U.S. Cl. ..... 165/104.16; 122/367 PF; 126/99 R; 165/DIG. 2; 236/1 G; 237/55

[58] Field of Search ..... 236/1 G; 165/104 F, 165/103, 104 M, 105, 185, DIG. 2, DIG. 12; 110/323, 324, 325; 122/367 PF, 367 R, 367 A, 367 C; 237/55

[56] References Cited

U.S. PATENT DOCUMENTS

| | | | |
|---|---|---|---|
| 1,015,131 | 1/1912 | Wilson et al. | 122/367 PF |
| 1,725,906 | 8/1929 | Gay | 165/DIG. 12 |
| 2,697,653 | 12/1954 | Nicholson | 165/104 F |
| 2,788,204 | 4/1957 | Kalling et al. | 165/DIG. 12 |
| 3,512,577 | 5/1970 | Javorsky | 165/104 F |
| 3,884,292 | 5/1975 | Pessolano et al. | 165/105 |
| 3,912,002 | 10/1975 | Elliott | 165/104 F |
| 4,040,477 | 8/1977 | Garberick | 165/DIG. 2 |
| 4,044,820 | 8/1977 | Nobles | 237/55 |
| 4,084,743 | 4/1978 | Matthews | 236/1 G |
| 4,096,909 | 6/1978 | Jukkola | 165/104 F |
| 4,108,369 | 8/1978 | Prikkel | 236/1 G |
| 4,149,586 | 4/1979 | Phillips et al. | 165/104 F |
| 4,189,090 | 2/1980 | Drinkuth | 236/1 G |
| 4,249,594 | 2/1981 | Elkins | 126/99 R |
| 4,249,883 | 2/1981 | Woolfolk | 236/1 G |
| 4,251,024 | 2/1981 | Feinberg | 236/1 G |
| 4,254,759 | 3/1981 | Schmidt | 236/1 G |

*Primary Examiner*—Daniel J. O'Connor
*Attorney, Agent, or Firm*—Thomas W. Speckman

[57] ABSTRACT

A heat exchanger and process having multiple fluidized beds for heat exchange between two gas streams of different temperatures. The apparatus and process provides a compact high efficiency warm air furnace especially adapted for energy conservation for the heating of modern highly insulated residential buildings by gas fired furnaces of relatively low rated gas input.

39 Claims, 7 Drawing Figures

FLUE PRODUCTS
70
30
80
RETURN AIR
61
FLUE PRODUCTS
71
V1
RETURN AIR
60
SUPPLY AIR
82
10
RETURN AIR
62
81
51
COMBUSTION AIR
50
GAS INPUT
68
BY PASS

FLUE PRODUCTS
70
30
66
V3
OUTSIDE AIR
65
83
FLUE PRODUCTS
71
SUPPLY AIR
81
10
V4
RETURN AIR
62
60
PREHEATED AIR
51
50
GAS INPUT
BY PASS

FLUE PRODUCTS
FLUE PRODUCTS
70
81
SUPPLY AIR
10
83
30
RETURN AIR
61
51
71
50
COMBUSTION AIR
68
GAS INPUT
BY PASS

FLUE PRODUCTS
SUPPLY AIR
35
32
33
132
136
31
36
135
131

34
134
132
32
31
33
131
FLUE PRODUCTS
RETURN AIR

HIGH EFFICIENCY FURNACE

This application is a continuation of application Ser. No. 16,206, filed Feb. 28, 1979, now U.S. Pat. No. 4,249,594.

This invention relates generally to heat exchangers having multiple fluidized beds for heat exchange between multiple gas streams of different temperatures. The heat exchangers of this invention having multiple fluidized beds may be used to provide high efficiency furnaces for residential heating. The multiple fluidized bed heat exchangers of this invention may be used in series to provide a compact, economical and energy conserving means for heating residential buildings, particularly those which are highly insulated and thus require a relatively low heat input.

Current residential warm air furnaces are in the order of approximately 60–75 percent efficient as measured by heat output to an enclosed space divided by heat energy input to the furnace. In addition to the desired economy of the higher efficiency furnace, governmental regulations are increasing efficiency requirements of both steady state and seasonal efficiencies. Reduction in the heating requirement due to insulation and tightening of residences results in the need for lower rated gas input furnaces in which higher efficiencies are even more difficult to obtain with conventional residential furnace heat exchanger technology. Also, future requirements will severely limit the $NO_x$ output from residential furnaces. Future restrictions will also require that no interior air be used for combustion and combustion products (flue) draft.

Present attempts to increase residential furnace efficiency with gas burning furnaces have been in the areas of electric flame ignition to eliminate gas consumption from a standing pilot light and mechanical closure of the flue passage during times of non-operation of the burner.

Fluidized beds of refractory particles have been previously used in connection with heaters. U.S. Pat. Nos. 3,884,617 and 3,903,846 teach the burning of gaseous fuel within a bed of fluidized refractory particles. U.S. Pat. No. 3,645,237 teaches the combustion of a gaseous fuel in the lower zone of a fluidized bed and transfer of heat to water passing through heating coils in the upper portion of the fluidized bed. U.S. Pat. No. 3,890,935 teaches a fluidized bed of particles through which flue gases pass from a combustion chamber with both the combustion chamber and the fluidized bed surrounded by a water jacket for thermal transfer to the contained water. U.S. Pat. No. 3,912,002 teaches a relatively shallow fluidized particulate bed for recovering heat from the exhaust gases produced in boilers by passage of water or steam to be heated through finned tubes immersed in the fluidized bed.

It is an object of this invention to provide a heat exchanger having at least one fluidized bed in each gas stream for heat exchange between multiple gas streams of different temperatures.

It is another object of this invention to provide a high efficiency furnace with multiple fluidized particulate beds for heat exchange between a flue gas stream and an air stream to be heated for introduction to heat an enclosed volume.

It is still another object of this invention to provide a gas fired residential heating furnace having higher than 75 percent seasonal efficiency.

It is yet another object of this invention to provide a compact, economical gas fired residential heating furnace in the 25,000 to 200,000 Btu input size.

It is still another object of this invention to provide a high efficiency residential heating furnace having low $NO_x$ content in the flue gas output to the ambient atmosphere.

It is yet another object of this invention to provide a residential heating furnace of high efficiency which may utilize outside ambient air for combustion.

Other objects and advantages of the invention will become apparent from the following description taken in conjunction with the accompanying drawings showing preferred embodiments wherein.

Figure 4A:
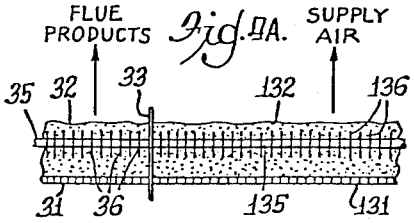
FIG. 4A is a sectional view of a portion of fluidized beds in a flue products stream and an air stream wherein a heat pipe with extended surfaces is in communication with each of the fluidized beds.
Figure 4B:
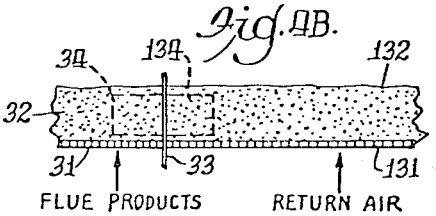
FIG. 4B is a sectional view of a portion of fluidized beds in a flue products stream and an air stream showing a thermal conductive wall having extended surfaces extending into each of the fluidized beds for thermal exchange.

The principles of the heat exchanger according to this invention may be best seen in FIGS. 4A and 4B. FIG. 4A shows thermal transfer partition 33 separating duct means for passage of two gas streams of different temperatures, in this case a flue products stream following fuel combustion and a supply air stream for heating an enclosed space such as a residence. In the flue products stream, fluidized bed 32 is maintained in the fluidized state supported by flue gas distributor 31. In the air stream fluidized bed 132 is maintained in the fluidized state supported by air stream distributor 131. The fluidized beds are made up of solid particles, as will be further discussed below, each supported by its respective distributor plate which provides for distribution of the gas flow throughout each fluidized bed. The passage of the gas stream through each bed is maintained at such a velocity that the beds of solid particles are maintained in a fluidized state while the respective gas streams are flowing through them. When small sized particulates are used in the fluidized beds, it may be desirable to provide for a separator above at least the last fluidized bed to reduce loss of the particles of the fluidized beds. A thermal exchange means is in communication with each of the fluidized beds transferring heat from the hotter to the cooler gas stream. In FIG. 4A the thermal exchange means is shown to be a heat pipe with end 35 having extended finned surfaces 36 embedded in fluidized bed 32 and the other end of the heat pipe having extended finned surfaces 136 extending into fluidized bed 132. Thus, heat is transferred from the hotter flue products stream by convection through thermal transfer partition 33 and by heat pipe 35-135 to the supply air stream. The wall thickness of thermal transfer partition 33 should be sufficiently thin to prevent excessive loss due to conduction along the partition. Each of the fluidized beds 32 and 132 enhance the heat transfer in their respective gas streams.

FIG. 4B is similar to FIG. 4A except that instead of a heat pipe for thermal exchange, thermal transfer partition 33 has extended fins 34 extending into fluidized bed 32 and extended fins 134 on the opposite side extending into fluidized bed 132.

A conventional warm air furnace typically requires about 6 square feet of heat transfer area to transfer heat by convection from an input of 25,000 Btu per hour (4.167 Btu/Hr.-sq.ft.) to an air stream. The multiple fluidized bed warm air furnace of this invention using particles of 0.20 mm. particle size requires about 2.2 square feet of heat transfer area to transfer heat from an input of 25,000 Btu per hour (11.364 Btu/Hr.-sq.ft.). The multiple fluidized bed warm air furnace of this invention results in a saving in heat transfer area of 63 percent as compared with a conventional warm air furnace.

The fluidized beds of solid particles for use in the heat exchangers of this invention have a depth, when in the fluidized state, of about ½ inch to about 4 inches and preferably of about 1 to about 4 inches. The thinner fluidized beds are desired for the conservation of power required to maintain their fluidized state. Suitable solid particles for the fluidized beds used in this invention have mean particle diameters of about 0.06 to about 0.60 millimeters and preferably about 0.20 to about 0.60 millimeters. Fluidized beds of solid particles are known to the art for thermal transfer and a variety of materials are known to be suitable. Solid particles of silica and alumina are preferred for use in this invention, but any suitable particulate material enhancing heat transfer may be used. Fluidized beds of the above depths and particle sizes may be maintained in a fluidized state by passing gas streams through them at velocities sufficiently high to maintain proper fluidization.

Any distributor plate providing low pressure drop while supporting the fluidized bed at the desired temperatures may be used. Metallic or ceramic distributor plates are suitable. For example sintered 316 stainless steel wire mesh laminate distributor plates may be used. In some applications, ceramic distributor plates may be used in the stages having highest temperatures.

Heat exchange according to this invention may be carried out between multiple gas streams of different temperatures wherein the principal heat exchange between two gas streams takes place in two fluidized beds, one located in each of the gas streams. A series of pairs of fluidized beds may be used and the flow of the two gas streams may be countercurrent with respect to the order of passage of a first stream through fluidized beds in heat transfer relation with fluidized beds of a second gas stream.

In one embodiment of this invention, the exchange of heat from a flue gas stream following combustion to an air stream for heating an enclosed space may advantageously take place between two gas streams passing through pairs of fluidized beds in thermal exchange with each other. Gas burning, forced air, heating furnaces, in the order of 25,000 to 200,000 Btu input, utilizing multiple fluidized bed heat transfer according to this invention, provide high efficiency furnaces of 75 to 95 percent efficiency. A practical upper efficiency is limited by condensation of flue gas, but efficiencies of about 80 to 85 percent, rated steady-state and seasonal, are attainable without condensation. Utilization of fluidized beds in the flue conduit to the atmosphere provides automatic flue closure upon stoppage of combustion. In a high efficiency furnace of this invention it is practical to use large amounts of excess air thereby cooling the flame and producing less $NO_x$. To provide fluidization velocities, as disclosed above, either a power burner or a suction blower in the flue products output may be used. Either of these provide for controlled amounts of excess air and readily utilize ambient air, thereby reducing production of $NO_x$. To achieve high furnace efficiency, multiple fluidized beds in series may be used in each the flue products and the air stream. Both the heat transfer coefficient and the furnace power requirements are dependent upon the fluidized bed materials, bed thickness, temperature and distributor plate porosity. The heat transfer coefficient measured in Btu per hour-foot$^2$-degree Fahrenheit increases with bed temperature. Therefore, it is desirable to pass only a portion of the return air air being circulated from the enclosed space through the fluidized bed heat exchangers and mixing the heated air stream with bypass return air to obtain the desired temperature. This will permit higher temperatures and more efficient heat transfer in the fluidized beds.

In a furnace of this invention having heat transfer in a fluidized particulate bed in both the flue gas stream and the air stream, power requirements are inversely related to the air stream temperature rise while the heat transfer area required is inversely proportional to the temperature difference between the flue gas and the air stream. To reduce power requirements, for a given heat energy input, the air stream temperature must be increased which can result in either a decrease in the temperature differences between the flue gas stream and the air stream, increasing heat transfer area requirements, or it can result in an increase in flue gas temperature, decreasing steady-state efficiency. In order to obtain a high efficiency furnace with a desired compact size, multiple stages of heat exchangers are preferred. All, or at least the latter stages, are preferably based upon fluidized bed heat transfer as described above. In some cases it may be desirable for the earlier stages to be based upon convective or radiative heat transfer. All such combinations are contemplated by this invention.

Figure 1:
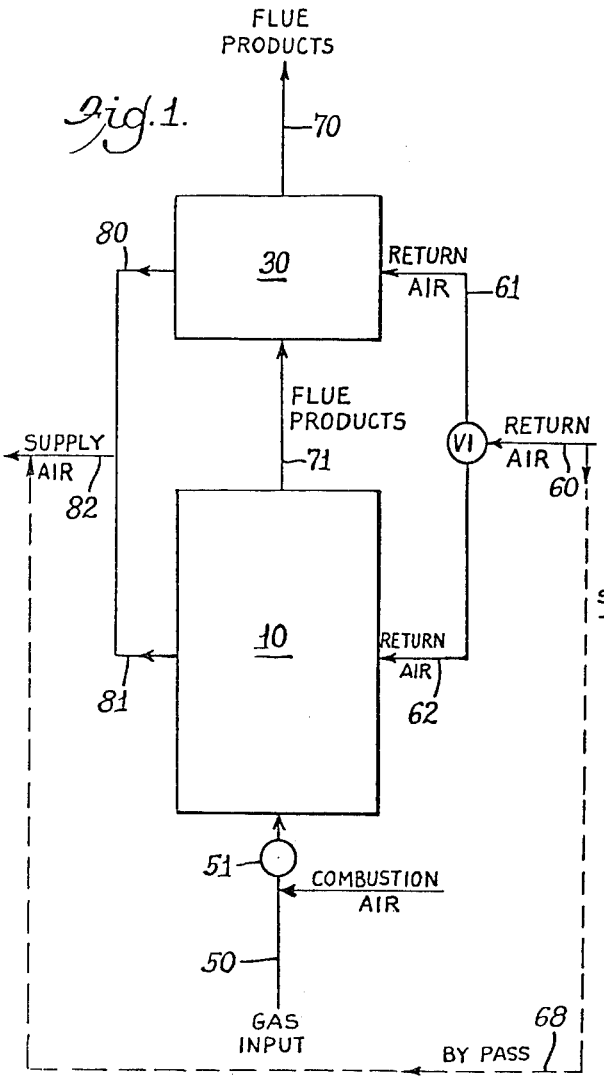
FIG. 1 is a schematic representation of a furnace according to this invention showing parallel air side heat exchange.

FIG. 1 is a simplified schematic drawing showing a parallel air stream heat exchange system for a furnace according to one embodiment of this invention. Flue gas from burner 51 is extracted by first stage heat exchanger 10 in series, with respect to the flue gas stream, with second stage heat exchanger 30 with flue products exhausted to the ambient air through conduit 70. Return air in conduit 60 from the space to be heated is divided between the first and second stage heat exchangers by valve $V_1$ and blended from conduits 80 and 81 to produce supply air in conduit 82 to be blended with the desired amount of bypass return air at a desired temperature for introduction to the space to be heated, in the order of 130° F. Bypass return air conduit 68 is shown passing from return air conduit 60 to supply air conduit 82. Not shown are necessary valving and means for movement of the air through conduit 68 which may be readily furnished by one skilled in the art to provide desired proportioning of the bypass air stream. Using this configuration, for a 25,000 Btu per hour input module, flue gases are passed through a first stage multiple fluidized bed of 2 inch bed height, in fluidized state, and a heat transfer area of about 0.6 square feet is supplied by plain thermal transfer partitions, similar to those shown in FIGS. 4A and 4B as 33, but without extended surfaces or heat pipes. The flue gas output from the first stage is passed through a second stage multiple fluidized bed having an entering temperature of 1200° F. and a fluidized bed height of 2 inches and a heat transfer area of about 0.6 square feet supplied by thermal transfer partition 33. In like sequence, a third stage multiple fluidized bed may be provided having a fluidized bed height of about 4 inches and a heat transfer area of 1.2 square feet to result in a low temperature, about 200° F., flue products output resulting in an efficiency of about 85 percent. In this embodiment, the multiple fluidized bed heat transfer exchange is especially suited for increasing the overall furnace efficiency by using the multiple fluidized bed heat transfer in a second stage and conventional convective heat exchange in a first stage.

Figure 2:
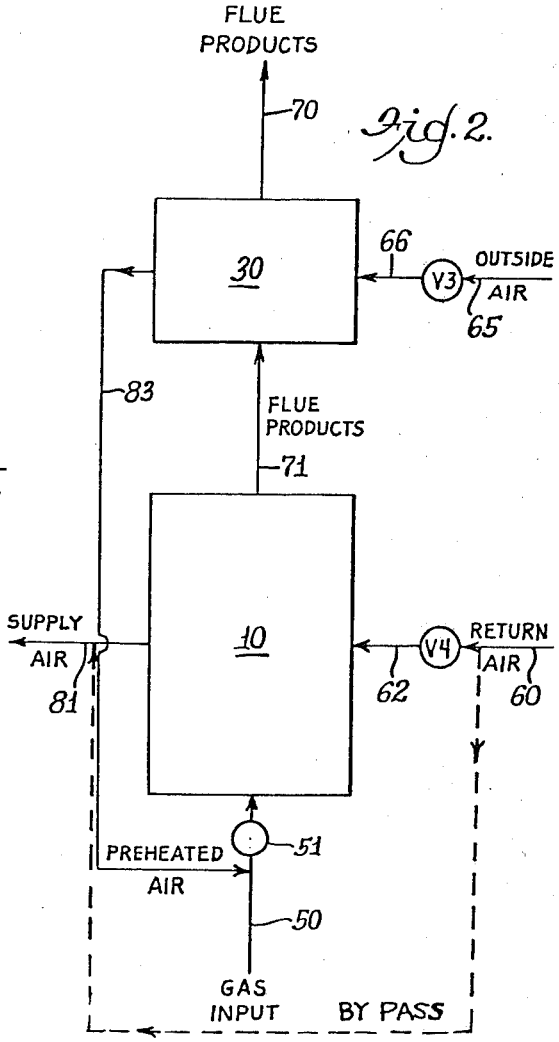
FIG. 2 is a schematic representation of a furnace according to this invention showing combustion air preheat.

Another embodiment of a high efficiency furnace according to this invention is shown by the schematic flow diagram of FIG. 2 wherein multiple fluidized beds are used in a second stage heat exchange for combustion air preheating only. This embodiment provides small physical equipment size and small power consumption. However, this embodiment results in higher adiabatic flame temperatures increasing the $NO_x$ emission and, therefore, a radiant power burner is desirably used to keep $NO_x$ emission levels low. Utilizing conventional furnace-type convection heat exchange in the first stage 10 and multiple fluidized bed heat exchange in second stage 30, overall efficiencies in the order of 82 percent can be obtained.

Figure 3:
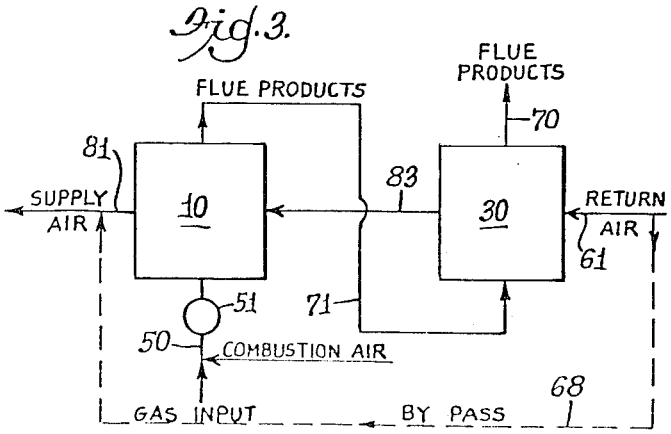
FIG. 3 is a schematic representation of a furnace according to this invention showing multiple heat exchangers in series in the flue gas stream and in the air stream to be heated.

FIG. 3 is a schematic representation of a countercurrent series flue gas-air stream exchange system. In this embodiment the combustion heat is extracted from flue gas in a countercurrent flow resulting in high supply air temperatures, to be blended in with bypass return air from conduit 68. The high supply air temperatures, in excess of 500° F., result in reduced air stream load on the heat exchangers and, therefore, reduced power consumption and size requirements of the heat exchanger.

In each of the embodiments utilizing multiple fluidized beds, it is preferred to use 2 to 4 stages of fluidized beds in series in each the flue gas duct and air duct. In a three stage embodiment having flow as shown in FIG. 3, the maximum pressure drop to be overcome is about 7 inches of water.

Figure 6:
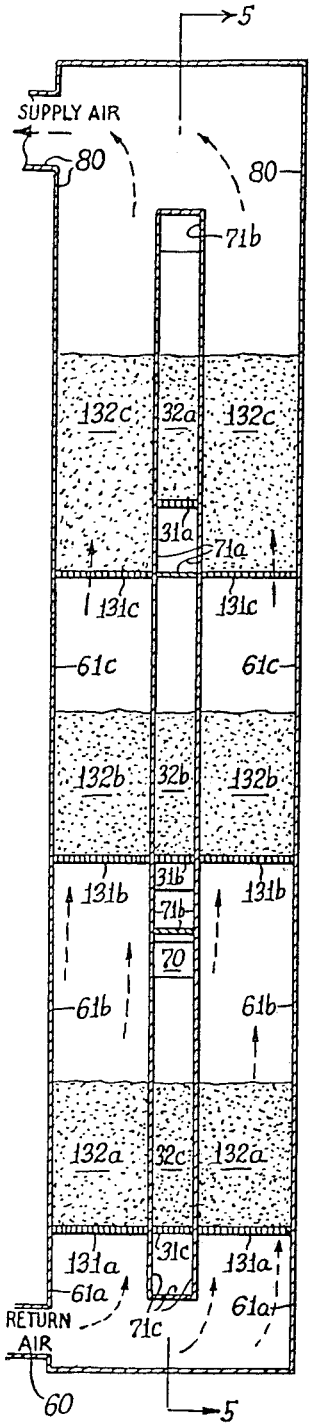
FIG. 6 is a cross-sectional view of the section 6—6 shown in FIG. 5.
Figure 5:
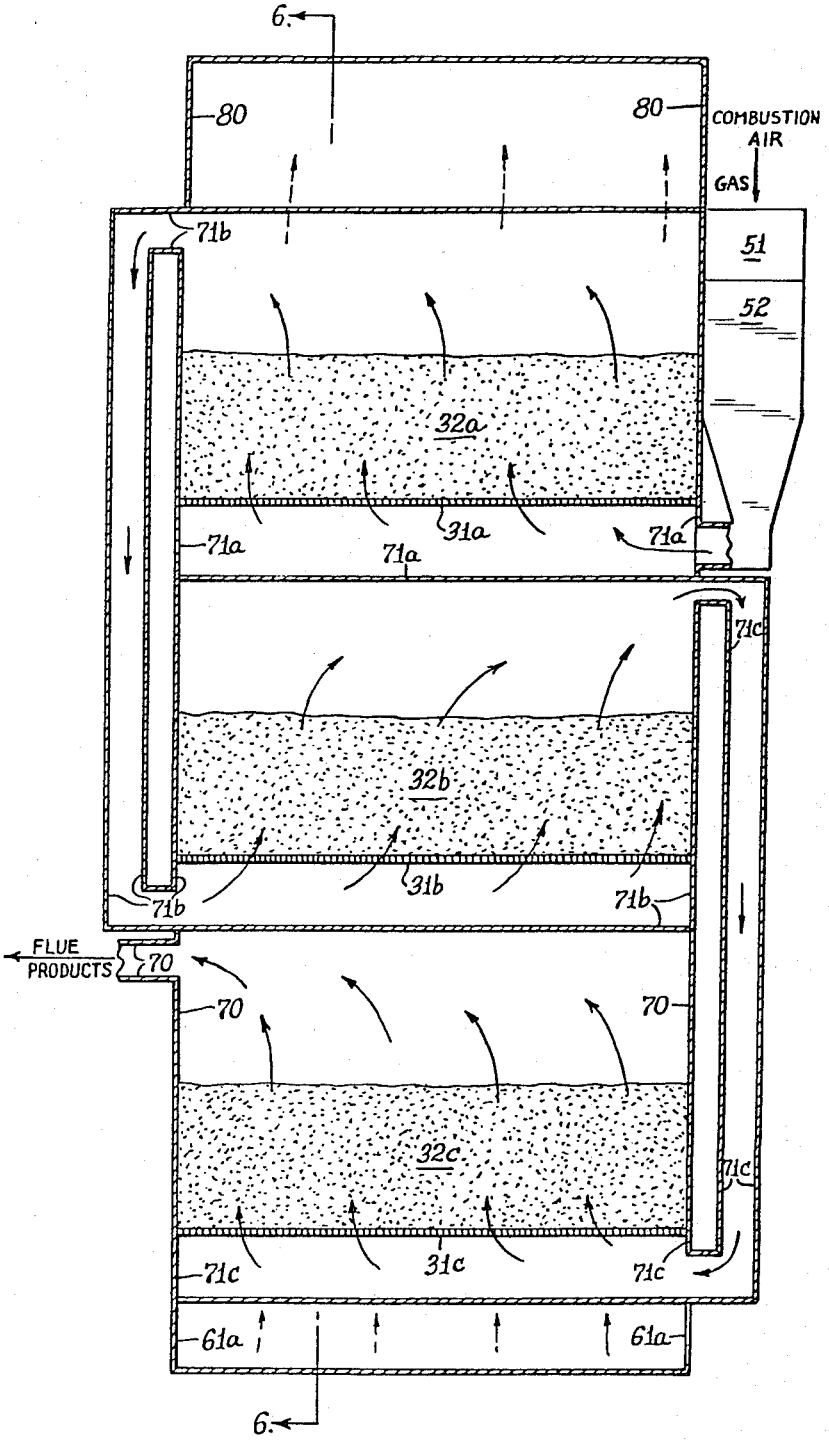
FIG. 5 is a cross-sectional view along line 5—5 of FIG. 6 of a high efficiency furnace according to one embodiment of this invention.

A more detailed view of the embodiment of a furnace as shown schematically in FIG. 3 is shown in FIGS. 5 and 6. FIG. 5 is a cross-sectional view of a high efficiency furnace according to one embodiment of this invention taken along line 5—5 as shown in FIG. 6, while FIG. 6 is a sectional view at right angles to that of FIG. 5 taken along line 6—6 shown in FIG. 5. The high efficiency furnace shown in FIGS. 5 and 6 has three stages of fluidized beds in countercurrent flow relationship. Combustion air and fuel gas is supplied to burner 51 in communication with combustion chamber 52. The outlet of combustion chamber 52 is in communication with flue gas duct 71*a* which conducts the flue gas through fluidized bed 32*a* supported by distributor plate 31*a*. Upon exiting fluidized bed 32*a* the flue gas is conducted by duct 71*b* to fluidized bed 32*b* maintained upon distributor 31*b*. Upon passing through fluidized bed 32*b*, the flue gas is conducted by duct 71*c* to fluidized bed 32*c* maintained upon distributor plate 31*c*. Upon leaving fluidized bed 32*c* the flue gas is conducted by duct 70 to the ambient atmosphere. The air stream is conducted through separate fluidized beds each in thermal exchange with a corresponding fluidized bed in the flue gas duct, both streams passing through their corresponding fluidized beds cocurrently, but the stages of fluidized beds in the flue gas stream and in the air stream arranged in countercurrent fashion. As shown in FIGS. 5 and 6, the flow of the flue gas is indicated by solid lines with arrows, while the flow of the air stream is indicated by dotted lines with arrows. Return air from the space to be heated is supplied to the furnace by return air duct 60 in communication with air duct 61*a* which conducts the air through fluidized bed 132*a* supported by distributor plate 131*a*. Upon exiting fluidized bed 132*a*, the air stream is conducted by duct 61*b* to fluidized bed 132*b* maintained upon distributor plate 131*b*. Upon passing through fluidized bed 132*b*, the air stream is conducted by duct 61*c* to fluidized bed 132*c* maintained upon distributor plate 131*c*. Upon leaving fluidized bed 132*c* the air stream is conducted by duct 80 to the space to be heated. For most efficient operation, a bypass is provided between return air duct 60 and supply air duct 80 exterior to the furnace for bypass of the furnace by cold room air which is mixed with hot air heated by passage through the furnace to result in desired supply air stream temperature to the space to be heated, in the order of 130° F. In such instances, it may be desirable to provide separate blowers for movement of the bypass air stream and movement of the air stream to be heated through the furnace.

A high efficiency furnace as shown in FIGS. 5 and 6 may be operated with silica particle rectangular beds of 2 to 4 inches depth, in the fluidized state, without extended heat transfer surfaces and temperatures in the following ranges may be achieved:

| Flue Gas Stream | | Air Stream | |
|---|---|---|---|
| Bed | Temperature °F. | Bed | Temperature °F. |
| 32a | 1200 | 132c | 800 |
| 32b | 500 | 132b | 300 |
| 32c | 200 | 132a | 150 |

In another embodiment of a furnace having the same flow as shown in FIGS. 5 and 6, extended heat exchange surfaces, as shown in FIG. 4B, may be used and bed heights of 1 to 2 inches provide equivalent heat exchange under the same load. The maximum pressure drop through the 3 beds to be overcome is reduced to about 1.1 to 2.2 inches of water.

The multiple stage fluidized bed heat transfer furnace of this invention provides design flexibility which may be used to advantage to obtain high efficiencies. Distributor plates of differing materials and porosities may be used with different sized particulate bed materials and differing heat requirements. The fluidized beds may be of differing particulate material, differing particulate size and different bed depths to obtain high efficiency. Further, either flat heat transfer surfaces or extended heat transfer surfaces may be used to obtain desired heat transfer efficiencies in accordance with economic requirements.

While the specific examples set forth above have been applied to a high efficiency furnace, it is readily seen that the multiple fluidized beds for heat exchange may be applied between any two gas streams having different temperatures, such as are encountered in a wide variety of applications in the chemical process industry. The process according to this invention provides heat exchange between two gas streams by passing a first gas stream through a first bed of solid particles at a velocity sufficient to maintain that bed in a fluidized state having a depth of about ½ inch to about 4 inches, passing a second gas stream having a lower temperature than the first gas stream through a second bed of solid particles at a velocity sufficient to maintain the second bed in a fluidized state having a depth of about ½ inch to 4 inches, and transferring heat from the first to the second bed, thereby cooling the first gas stream and heating the second gas stream.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a high efficiency furnace, multiple fluidized bed means for heat exchange between two gas streams comprising:

flue gas duct means for conveyance of flue gas from a burner;

a first quantity of solid particles capable of operation at flue gas temperatures of about 200° to about 1200° F. comprising a first fluidized bed within said flue gas duct means and providing automatic flue closure upon stoppage of combustion;

distributor means for supporting said first fluidized bed and for admitting flue gas thereto and distributing flue gas throughout said first fluidized bed;

air duct means exterior to said flue gas duct means for the portion of its length passing through said first fluidized bed for conveyance of an air stream to be heated for introduction to heat an enclosed volume;

a second quantity of solid particles comprising a second fluidized bed within said air duct means;

distributor means for supporting said second fluidized bed and for admitting air thereto and distributing the air to be heated throughout said second fluidized bed;

thermal exchange means in communication with said first and second fluidized beds transferring heat from said first to said second fluidized bed;

each of said fluidized beds having a depth, when in fluidied state, of about ½ inch to about 4 inches.

2. The high efficiency furnace of claim 1 wherein each of said fluidized beds has a depth, when in the fluidized state, of about 1 to about 4 inches.

3. The high efficiency furnace of claim 1 wherein said solid particles have means particle diameters of about 0.06 to about 0.60 millimeters.

4. The high efficiency furnace of claim 3 wherein said solid particles have mean particle diameters of about 0.20 to about 0.60 millimeters.

5. The high efficiency furnace of claim 1 wherein said solid particles are selected from the group consisting of silica and alumina.

6. The high efficiency furnace of claim 1 wherein said thermal exchange means comprises a thin thermal conductive wall between and in thermal conductive relation with said first and second fluidized beds.

7. The high efficiency furnace of claim 6 wherein said thin thermal conductive wall has extended surfaces extending into each of said fluidized beds.

8. A high efficiency furnace for heating an enclosed space comprising:

combustion chamber;

a burner within said combustion chamber;

a flue gas duct means having a first and second open end in communication at said first open end with said combustion chamber and at said second end with the ambient atmosphere;

a first blower means for movement of flue gas through said flue gas duct from said first to said second open end;

a first quantity of solid particles capable of operation at flue gas temperatures of about 200° to about 1200° F. comprising a first fluidized bed within said flue gas duct means and providing automatic flue closure upon stoppage of combustion;

distributor means for supporting said first fluidized bed and for admitting flue gas thereto and distributing flue gas throughout said first fluidized bed;

air duct means exterior to said flue gas duct means for the portion of its length passing through said first fluidized bed and having a first and second open end in communication at said first open end with the space to be heated and/or ambient air and at said second open end with the space to be heated;

a second blower means for movement of said air stream through said air duct means from said first to said second open end;

a second quantity of solid particles comprising a second fluidized bed within said air duct means;

distributor means for supporting said second fluidized bed and for admitting air thereto and distributing the air to be heated throughout said second fluidized bed;

thermal exchange means in communication with said first and second fluidized beds transferring heat from said first to said second fluidized bed;

each of said fluidized beds having a depth, when in fluidized state, of about ½ inch to about 4 inches.

9. The high efficiency furnace of claim 8 wherein each of said fluidized beds has a depth, when in the fluidized state, of about 1 to about 4 inches.

10. The high efficiency furnace of claim 8 wherein said solid particles have mean particle diameters of about 0.06 to about 0.60 millimeters.

11. The high efficiency furnace of claim 8 wherein said solid particles have mean particle diameters of about 0.20 to about 0.60 millimeters.

12. The high efficiency furnace of claim 8 wherein said solid particles are selected from the group consisting of silica and alumina.

13. The high efficiency furnace of claim 8 wherein said thermal exchange means comprises a thin thermal conductive wall between and in thermal conductive relation with said first and second fluidized beds.

14. The high efficiency furnace of claim 13 wherein said thin thermal conductive wall has extended surfaces extending into each of said fluidized beds.

15. The high efficiency furnace of claim 8 having two to four sets of said fluidized beds in series in each of said flue gas duct means and air duct means.

16. The high efficiency furnace of claim 15 wherein said flue gas duct means passes through a central portion of said fluidized beds within said air duct means.

17. The high efficiency furnace of claim 15 wherein said series of fluidized beds in said flue gas duct means is in thermal exchange communication with said series of fluidized beds in said air duct means in countercurrent flow relation to the flow of flue gas and air within said duct means.

18. The high efficiency furnace of claim 17 additionally having an air bypass duct means in communication with said air duct means first and second open end whereby a portion of the air for heating said enclosed space bypasses said fluidized beds within said air duct means.

19. The high efficiency furnace of claim 17 wherein said burner is a power burner.

20. The high efficiency furnace of claim 8 having two or more stages of heat exchange in series with respect to said flue gas duct means and in parallel with respect to said air duct means comprising:

a first heat exchange means toward said first open end of said flue gas duct means;

a second heat exchange means toward said second open end of said flue gas duct means comprising said first and second fluidized beds;

said air duct means toward said first open end being divided providing first portion air duct passage in said first heat exchange means and second portion air duct passage in said second heat exchange means, said first and second portion air duct passages rejoining said air duct means prior to said air duct means second open end.

21. The high efficiency furnace of claim 20 wherein said first heat exchange means is a convective heat exchange means.

22. The high efficiency furnace of claim 20 wherein said first heat exchange means comprises:

a third quantity of solid particles capable of operation at flue gas temperatures of about 200° to about 1200° F. comprising a third fluidized bed within said flue gas duct means;

distributor means for supporting said third fluidized bed and for admitting flue gas thereto and distributing flue gas throughout said third fluidized bed;

air duct means exterior to said flue gas duct means for the portion of its length passing through said third fluidized bed and having a first and second open end in communication at said first open end with the space to be heated and/or ambient air and at said second open end with the space to be heated;

a fourth quantity of solid particles comprising a fourth fluidized bed within said air duct means;

distributor means for supporting said fourth fluidized bed and for admitting air thereto and distributing the air to be heated throughout said fourth fluidized bed;

thermal exchange means in communication with said third and fourth fluidized bed transferring heat from said third to said fourth fluidized bed; and each of said fluidized beds having a depth, when in fluidized state, of about ½ inch to about 4 inches.

23. The high efficiency furnace of claim 20 wherein said solid particles have mean particle diameters of about 0.06 to about 0.60 millimeters.

24. The high efficiency furnace of claim 20 wherein said solid particles are selected from the group consisting of silica and alumina.

25. The high efficiency furnace of claim 20 additionally having an air bypass duct means in communication with said air duct means first and second open end whereby a portion of the air for heating said enclosed space bypasses said fluidized beds within said air duct means.

26. The high efficiency furnace of claim 8 wherein said burner is a power burner.

27. The high efficiency furnace of claim 20 wherein said burner is a power burner.

28. The high efficiency furnace of claim 8 wherein said burner is a radiant power burner.

29. The high efficiency furnace of claim 20 wherein said burner is a radiant power burner.

30. The high efficiency furnace of claim 8 having a suction blower.

31. The high efficiency furnace of claim 20 having a suction blower.

32. A high efficiency furnace for heating an enclosed space having two or more stages of heat exchange in series in a combustion flue gas duct comprising:

a combustion chamber;

a burner within said combustion chamber;

flue gas duct means having a first and second open end in communication at said first open end with said combustion chamber and at said second end with the ambient atmosphere;

a first blower means for movement of flue gas through said flue gas duct from said first to said second open end;

a first heat exchange means toward said first open end of said flue gas duct means for heating supply air to said enclosed space;

a second heat exchange means toward said second open end of said flue gas duct means comprising:

(a) a first quantity of solid particles capable of operation at flue gas temperatures of about 200° to about 1200° F. comprising a first fluidized bed within said flue gas duct means and providing automatic flue closure upon stoppage of combustion;

(b) distributor means for supporting said first fluidized bed and for admitting flue gas thereto and distributing flue gas throughout said first fluidized bed;

(c) air duct means exterior to said flue gas duct means for the portion of its length passing through said first fluidized bed and having a first and second open end in communication at said first open end with ambient air and at said second open end with said burner to be provided preheated air;

(d) a second blower means for movement of said air stream through said air duct means from said first to said second open end;

(e) a second quantity of solid particles comprising a second fluidized bed within said air duct means;

(f) distributor means for supporting said second fluidized bed and for admitting air thereto and distributing the air to be heated throughout said second fluidized bed;

(g) thermal exchange means in communication with said first and second fluidized beds transferring heat from said first to said second fluidized bed;

(h) each of said fluidized beds having a depth, when in fluidized state, of about ½ inch to about 4 inches.

33. The high efficiency furnace of claim 32 wherein said first heat exchange means is a convective heat exchange means.

34. The high efficiency furnace of claim 32 wherein said first heat exchange means comprises:

a third quantity of solid particles capable of operation at flue gas temperatures of about 200° to about 1200° F. comprising a third fluidized bed within said flue gas duct means;

distributor means for supporting said third fluidized bed and for admitting flue gas thereto and distributing flue gas throughout said third fluidized bed;

air duct means surrounding said flue gas duct means for the portion of its length passing through said third fluidized bed and having a first and second open end in communication at said first open end with the space to be heated and/or ambient air and at said second open end with the space to be heated;

a fourth quantity of solid particles comprising a fourth fluidized bed within said air duct means;

distributor means for supporting said fourth fluidized bed and for admitting air thereto and distributing the air to be heated throughout said fourth fluidized bed;

thermal exchange means in communication with said third and fourth fluidized bed transferring heat from said third to said fourth fluidized bed; and each of said fluidized beds having a depth, when in fluidized state, of about ½ inch to about 4 inches.

35. The high efficiency furnace of claim 32 wherein said solid particles have mean particle diameters of about 0.06 to about 0.60 millimeters.

36. The high efficiency furnace of claim 32 wherein said solid particles are selected from the group consisting of silica and alumina.

37. The high efficiency furnace of claim 32 wherein said burner is a power burner.

38. The high efficiency furnace of claim 32 wherein said burner is a radiant power burner.

39. The high efficiency furnace of claim 32 having a suction blower.

* * * * *